US012305957B2

(12) United States Patent
Ozanne et al.

(10) Patent No.: US 12,305,957 B2
(45) Date of Patent: May 20, 2025

(54) AIMING APPARATUS

(71) Applicants: Jeffrey A. Ozanne, La Crosse, WI (US); Jeffrey J. Ozanne, Norwalk, WI (US)

(72) Inventors: Jeffrey A. Ozanne, La Crosse, WI (US); Jeffrey J. Ozanne, Norwalk, WI (US)

( * ) Notice: Subject to any disclaimer, the term of this patent is extended or adjusted under 35 U.S.C. 154(b) by 0 days.

(21) Appl. No.: 18/382,382

(22) Filed: Oct. 20, 2023

(65) Prior Publication Data

US 2024/0053122 A1 Feb. 15, 2024

Related U.S. Application Data

(63) Continuation of application No. 17/314,704, filed on May 7, 2021, now abandoned.

(60) Provisional application No. 63/021,091, filed on May 7, 2020.

(51) Int. Cl.
*F41G 1/01* (2006.01)
*F41G 1/033* (2006.01)
*F41G 1/10* (2006.01)

(52) U.S. Cl.
CPC ..... *F41G 1/01* (2013.01); *F41G 1/033* (2013.01); *F41G 1/10* (2013.01)

(58) Field of Classification Search
None
See application file for complete search history.

(56) References Cited

U.S. PATENT DOCUMENTS 154,871 A * 9/1874 Johnson ..... F41G 1/01 42/145
783,092 A * 2/1905 Bassell ..... F41G 1/28 42/136
811,267 A * 1/1906 Andrus ..... F41G 1/28 42/136
821,821 A * 5/1906 Nickerson ..... F41G 1/473 42/142
1,004,241 A * 9/1911 Chadwick ..... F41G 1/28 42/136
1,363,553 A * 12/1920 Moreau ..... F41G 1/32 42/145

(Continued)

FOREIGN PATENT DOCUMENTS

DE 390295 C * 2/2024
FR 3134174 A1 * 10/2023 ..... F41G 1/01
WO WO-2020246911 A1 * 12/2020 ..... F41G 1/01

OTHER PUBLICATIONS

Dueck. Dueck Defense Fixed Rear | Red Fiber Optic Front Sight. <http://www.vdmsr.com/2016/02/dueck-defense-fixed-rear-red-fiber.html>. Feb. 10, 2016. (Year: 2016) (Year: 2016).*

*Primary Examiner* — Gabriel J. Klein

(74) *Attorney, Agent, or Firm* — Laabs Intellectual Property

(57) ABSTRACT

In some embodiments, an apparatus comprises a first body and a second body aligned upon an axis. The first body comprises a first sight window and a first side edge, a second side edge and a base edge defining the first sight window, and a first central indicator. The second body comprises a second sight window and a first side edge, a second side edge and a base edge defining the second sight window, and a second central indicator. The axis extends through a center of the first sight window and through a center of the second sight window.

19 Claims, 19 Drawing Sheets

(56) References Cited

U.S. PATENT DOCUMENTS

| | | | | | |
|---|---|---|---|---|---|
| 2,610,405 | A * | 9/1952 | Dickinson | F41G 1/30 | 42/144 |
| 3,641,676 | A * | 2/1972 | Knutsen | F41G 1/32 | 42/145 |
| 3,698,091 | A * | 10/1972 | Merrill | F41G 1/01 | 42/144 |
| 3,698,092 | A * | 10/1972 | Rosenhan | F41G 1/345 | 42/132 |
| 3,834,035 | A * | 9/1974 | Merrill | F41G 1/08 | 42/133 |
| 3,984,917 | A * | 10/1976 | Korzeniewski | F41G 1/473 | 42/143 |
| 4,309,095 | A * | 1/1982 | Buckley | F41C 27/00 | 396/420 |
| 5,887,352 | A * | 3/1999 | Kim | F41G 1/08 | 42/144 |
| 6,112,422 | A * | 9/2000 | Laiche, Jr. | F41G 1/26 | 42/137 |
| 8,452,171 | B1 * | 5/2013 | Beitman, Sr. | G03B 17/56 | 396/375 |
| 9,658,030 | B1 * | 5/2017 | Heacock | F41G 1/02 | |
| 9,915,501 | B2 * | 3/2018 | Grey | F41G 1/10 | |
| 10,365,065 | B1 * | 7/2019 | Smith | F41G 1/10 | |
| 2016/0258715 | A1 * | 9/2016 | Grey | F41G 1/02 | |
| 2018/0135940 | A1 * | 5/2018 | Neuhaus | F41G 1/12 | |
| 2021/0348881 | A1 * | 11/2021 | Ozanne | F41G 1/10 | |

* cited by examiner

AIMING APPARATUS

CROSS-REFERENCE TO RELATED APPLICATIONS

This application claims the benefit and is a continuation of U.S. patent application Ser. No. 17/314,704, filed May 7, 2021, which claims the benefit of U.S. Patent Application No. 63/021,091, filed May 7, 2020, the entire content of each of which is hereby incorporated herein by reference.

BACKGROUND OF THE INVENTION

This invention relates generally to sighting devices and more particularly to sights used on projectile launching devices, optical devices and other suitable devices used to view a target. Iron sights are generally known in the art as a pair of physical aiming structures located a distance from one another. When positioned and aligned appropriately, these aiming structures help align a device with the target.

Traditional iron sights use a front sight having a central pin or indicator, which helps to align the device on the center of the target; however, because the pin extends to the center, it generally occludes a portion of the target. A drawback to traditional iron sighs is occlusion of the target by the sight structures. There remains a need for novel sighting structures that allow for fast target acquisition, better target visibility and added precision.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an apparatus comprises a first body and a second body aligned upon an axis. The first body comprises a first sight window and a first side edge, a second side edge and a base edge defining the first sight window. The second body comprises a second sight window and a first side edge, a second side edge and a base edge defining the second sight window. The axis extends through a center of the first sight window and through a center of the second sight window.

In some embodiments, an apparatus comprises a first body and a second body aligned upon an axis. The first body comprises a first sight window, a first indicator located to a first side of the first sight window and a second indicator located to a second side of the first sight window. The second body comprises a second sight window, a third indicator located to a first side of the second sight window and a fourth indicator located to a second side of the second sight window. The third indicator and the fourth indicator are visible through the first sight window. In some embodiments, a width of the first sight window is greater than a distance between the third indicator and the fourth indicator.

In some embodiments, a method comprises orienting a device comprising a first body comprising a first sight window and a second body comprising a second sight window. The second sight window is visible through the first sight window. A target is visible through the first sight window and the second sight window.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
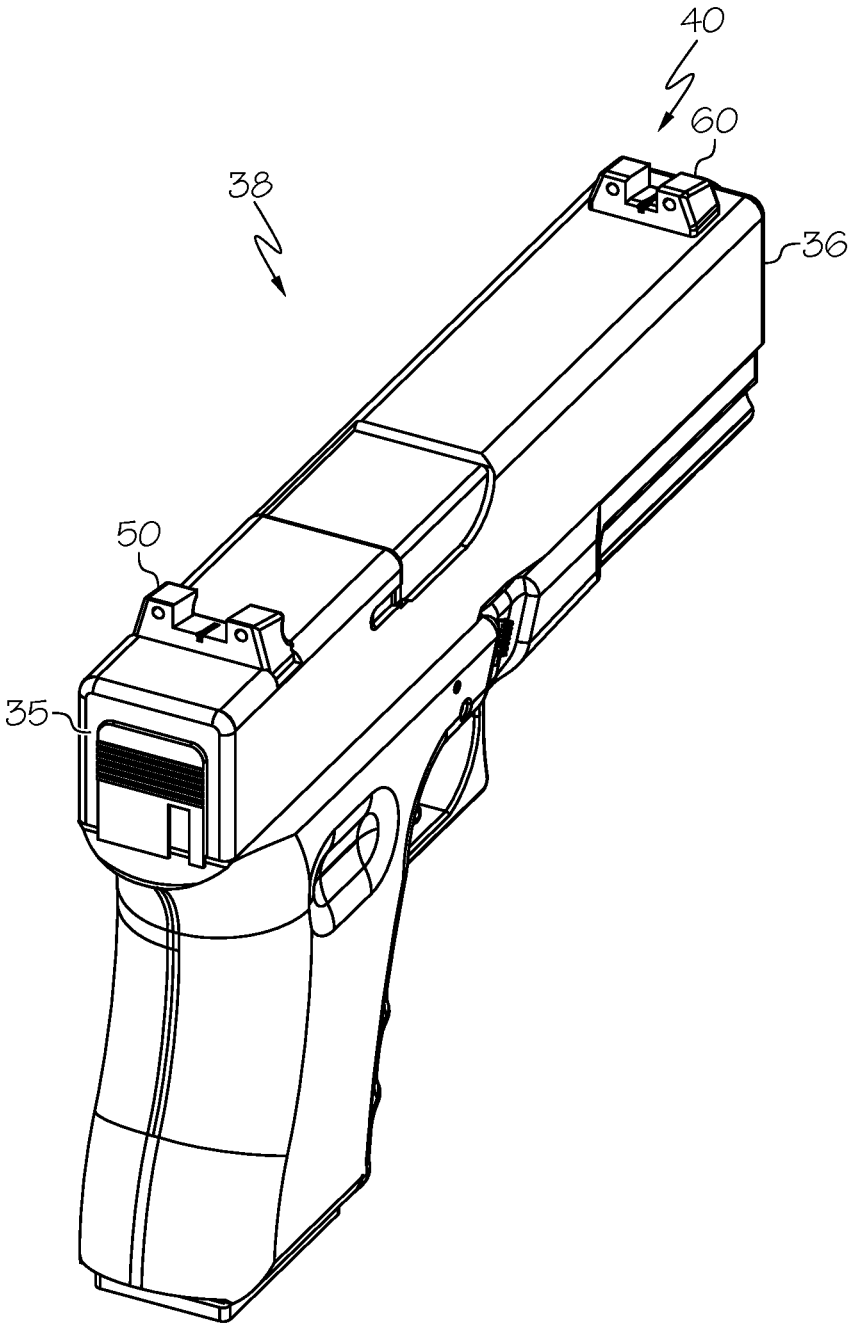
FIG. 1 shows an embodiment of a device comprising an aiming apparatus.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a device 38 comprising an embodiment of an aiming apparatus 40. In some embodiments, the aiming apparatus 40 comprises a first body 50 attached to the device 38 and a second body 60 attached to the device. Desirably, the aiming apparatus 40 is arranged to help a user aim the device 38, for example by visually aligning the first body 50 and second body 60.

In some embodiments, a device 38 comprises a firearm. As shown in FIG. 1, the device 38 comprises a pistol. In some embodiments, a device 38 comprises a rifle, long gun, shotgun or any other suitable type of firearm. In some embodiments, a device 38 comprises any suitable projectile launching device. In some embodiments, a device 38 comprises an optical device such as a spotting scope.

In some embodiments, the device 38 comprises a rear end 35 and a front end 36. In some embodiments, the first body 50 is attached to the device 38 at a location that is closer to the rear end 35 than to the front end 36. In some embodiments, the second body 60 is attached to the device 38 at a location that is closer to the front end 36 than to the rear end 35.

Figure 2:
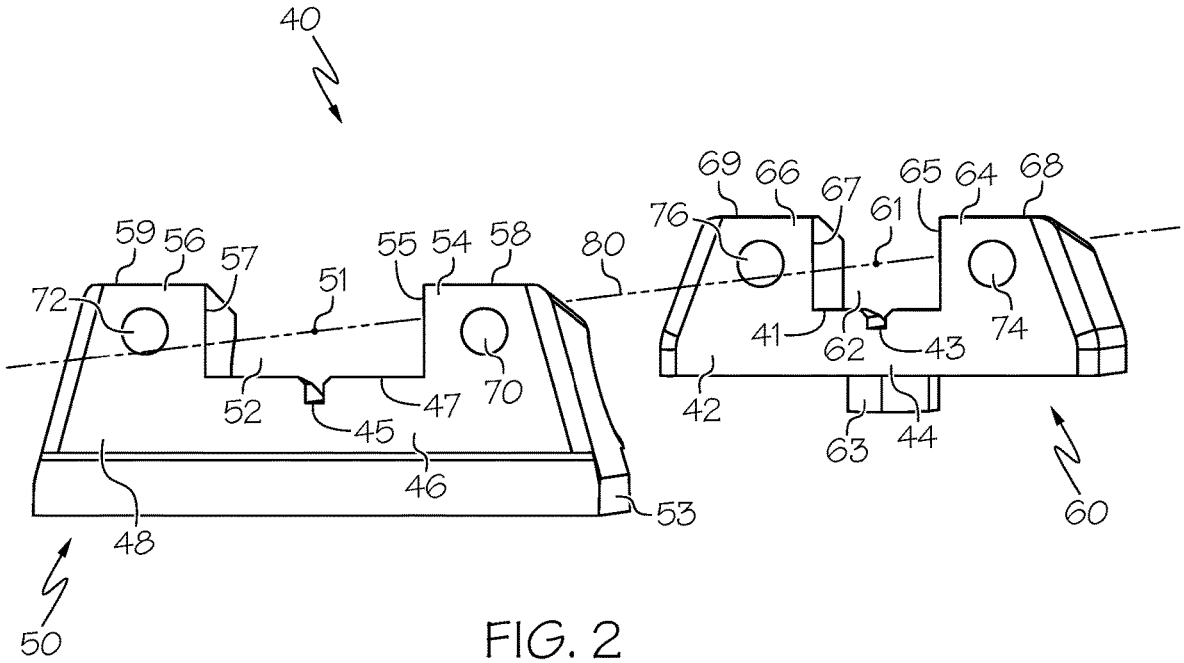
FIG. 2 shows another view of an embodiment of an aiming apparatus.

FIG. 2 shows the embodiment of an aiming apparatus 40 shown in FIG. 1. In some embodiments, the first body 50 comprises a sight window 52. In some embodiments, the sight window 52 comprises an open space. In some embodiments, the sight window 52 comprises an airspace. In some embodiments, the sight window 52 allows visible light to pass through the sight window 52. In some embodiments, a sight window 52 can have any suitable size, shape and configuration. Desirably, the sight window 52 allows a viewing area or targeting area located in front of the first body 50 to be seen by a user positioned behind the first body 50.

In some embodiments, the first body 50 comprises a first raised portion 54 located to a first side of the sight window 52. In some embodiments, the first body 50 comprises a second raised portion 56 located to a second side of the sight window 52. In some embodiments, the first raised portion 54 comprises an edge 55 that comprises a first side of the sight window 52. In some embodiments, the second raised portion 56 comprises an edge 57 that comprises a second side of the sight window 52. In some embodiments, the first edge 55 and second edge 57 comprise opposed sides of the sight window 52. In some embodiments, the first body 50 comprises a central portion 46 comprising an edge 47. In some embodiments, the edge 47 comprises a bottom side or base edge of the sight window 52.

In some embodiments, the sight window 52 is generally rectangular. In some embodiments, the first edge 55 is parallel to the second edge 57 and perpendicular to the edge 47 that comprises the bottom of the sight window 52. In some embodiments, a top edge 58 of the first raised portion 54 is parallel to a top edge 59 of the second raised portion 56. In some embodiments, the sight window 52 comprises a center 51.

In various embodiments, the first sight window 52 can have any suitable shape. Desirably, at least a portion of the second body 60 is viewable through the first sight window 52. In some embodiments, the first edge 55 and second edge 57 are nonparallel. In some embodiments, the first sight window 52 comprises a trapezoidal shape. In some embodiments, the first edge 55 and second edge 57 comprise curvature.

In some embodiments, the first body 50 comprises a planar surface 48. In some embodiments, the planar surface 48 comprises the edges 47, 55, 57 that define the sight window 52.

In some embodiments, the first body 50 comprises a first indicator 70. In some embodiments, the first body 50 comprises a second indicator 72. In some embodiments, the first raised portion 54 comprises the first indicator 70. In some embodiments, the second raised portion 56 comprises the second indicator 72. In some embodiments, an indicator 70, 72 comprises a visual indicator arranged to visually contrast with adjacent portions of the first body 50. For example, in some embodiments, the planar surface 48 comprises a dark color and the indicators 70, 72 comprise a light, bright or otherwise contrasting color. In some embodiments, an indicator 70, 72 comprises a light transmitting or light producing device, such as a light, an LED, a fiber optic line or any other suitable device or material. In some embodiments, an indicator 70, 72 comprises a radioluminescent material such as tritium.

An indicator 70, 72 can comprise any suitable size and shape. In some embodiments, an indicator 70, 72 is round. In some embodiments, an indicator 70, 72 is square. In some embodiments, an indicator 70, 72 is rectangular. In some embodiments, the second indicator 72 comprises a size and shape that is similar to the first indicator 70. In some embodiments, the second indicator 72 is positioned symmetrically with respect to the first indicator 70 across the sight window 52. In some embodiments, a distance between the top edge 58 of the first raised portion 54 and the center of the first indicator 70 is similar to a distance between the top edge 59 of the second raised portion 56 and the center of the second indicator 72. In some embodiments, a distance from the center 51 of the sight window 52 to the center of the first indicator 70 is similar to a distance from the center 51 of the sight window 52 to the center of the second indicator 72.

In some embodiments, the first body 50 comprises a central indicator 45 located below the sight window 52. In some embodiments, the central indicator 45 is positioned on a midline of the first body 50. In some embodiments, the central indicator comprises a channel extending into the central portion 46 of the first body 50. In some embodiments, the central indicator 45 interrupts the base edge 47 of the sight window 52.

In some embodiments, the first body 50 comprises a first indicator 70 located to a first side of the sight window 52, a second indicator 72 located to a second side of the sight window 52 and a third indicator 45 located to a third side of the sight window 52. In some embodiments, the third indicator 45 is located adjacent to the base edge 47 of the sight window 52. In some embodiments, the first indicator 70 and second indicator 72 are similar to one another. In some embodiments, the third indicator 45 is different from the first indicator 70 and the second indicator 72.

In some embodiments, the first body 50 comprises a base portion 53 arranged to engage a device 38. In some embodiments, the base portion 53 comprises a trapezoidal or dovetail shape arranged to engage a complimentary shaped slot, for example in a device 38. In some embodiments, a base portion 53 comprises a protrusion arranged to occupy a mounting hole or slot in the device 38. In some embodiments, a base portion 53 comprises a threaded aperture arranged to engage a fastener.

In some embodiments, the second body 60 comprises a second sight window 62. In some embodiments, the second sight window 62 comprises an open space. In some embodiments, the second sight window 62 comprises an airspace. In some embodiments, the second sight window 62 allows visible light to pass through the second sight window 62. In some embodiments, a second sight window 62 can have any suitable size, shape and configuration. Desirably, the second sight window 62 allows a targeting area located in front of the second body 60 to be seen by a user positioned behind the second body 60. Desirably, the second sight window 62 excludes any sighting pin or other structure that would occlude a center 61 of the second sight window 62.

In some embodiments, the second body 60 comprises a first raised portion 64 located to a first side of the second sight window 62. In some embodiments, the second body 60 comprises a second raised portion 66 located to a second side of the second sight window 62. In some embodiments, the first raised portion 64 comprises an edge 65 that comprises a first side of the second sight window 62. In some embodiments, the second raised portion 66 comprises an edge 67 that comprises a second side of the second sight window 62. In some embodiments, the first edge 65 and second edge 67 comprise opposed sides of the second sight window 62. In some embodiments, the second body 50 comprises a central portion 44 comprising an edge 41. In some embodiments, the edge 41 comprises a bottom side or base edge of the second sight window 62.

The second sight window 62 can have any suitable size and shape. In some embodiments, a width of the second sight window 62 is less than a width of the first sight window 52.

In some embodiments, the first edge 55 of the first sight window 52 is parallel to the first edge 65 of the second sight window 62. In some embodiments, the second edge 57 of the first sight window 52 is parallel to the second edge 67 of the second sight window 62. In some embodiments, the base edge 47 of the first sight window 52 is parallel to the base edge 41 of the second sight window 62.

In some embodiments, the second body 60 comprises a planar surface 42. In some embodiments, the planar surface 42 comprises the edges 41, 65, 67 that define the second sight window 62.

In some embodiments, the second body 60 comprises a first indicator 74. In some embodiments, the second body 60 comprises a second indicator 76. In some embodiments, for example when the first body 50 comprises indicators 70, 72, the second body 60 can be considered to comprise a third indicator 74 and a fourth indicator 76. In some embodiments, the first raised portion 64 comprises the third indicator 74. In some embodiments, the second raised portion 66 comprises the fourth indicator 76.

In some embodiments, the indicators 74, 76 in the second body 60 can have any suitable size, shape and configuration, for example as described with respect to indicators 70, 72 in the first body 50. In some embodiments, indicators 74, 76 in the second body 60 are similar to indicators 70, 72 in the first body 50.

In some embodiments, a width of the first sight window 52 is greater than a distance between the indicators 74, 76 of the second body 60, and at least a portion of each indicator 74, 76 is visible through the first sight window 52. In some embodiments, a width of the first sight window 52 is greater than a distance between the outermost portions of the indicators 74, 76 of the second body 60, and the entire indicators 74, 76 are visible through the first sight window 52.

In some embodiments, the second body 50 comprises a central indicator 43 located below the second sight window 62. In some embodiments, the central indicator 43 is positioned on a midline of the second body 60. In some embodiments, the central indicator 43 comprises a channel extending into the central portion 44 of the second body 60. In some embodiments, the central indicator 43 interrupts the base edge 41 of the second sight window 62.

In some embodiments, the second body 60 comprises a first indicator 74 located to a first side of the second sight window 62, a second indicator 76 located to a second side of the second sight window 62 and a third indicator 43 located to a third side of the second sight window 62. In some embodiments, the third indicator 43 is located adjacent to the base edge 41 of the second sight window 62. In some embodiments, the first indicator 74 and second indicator 76 are similar to one another. In some embodiments, the third indicator 43 is different from the first indicator 74 and the second indicator 76.

In some embodiments, the second body 60 comprises a base portion 63 arranged to engage a device 38. In some embodiments, the base portion 63 comprises a protrusion arranged to occupy a mounting hole or slot in the device 38. In some embodiments, the base portion 63 comprises a threaded aperture arranged to engage a fastener. In some embodiments, the base portion 63 comprises a trapezoidal or dovetail shape arranged to engage a complimentary shaped slot in a device 38.

Figure 3:
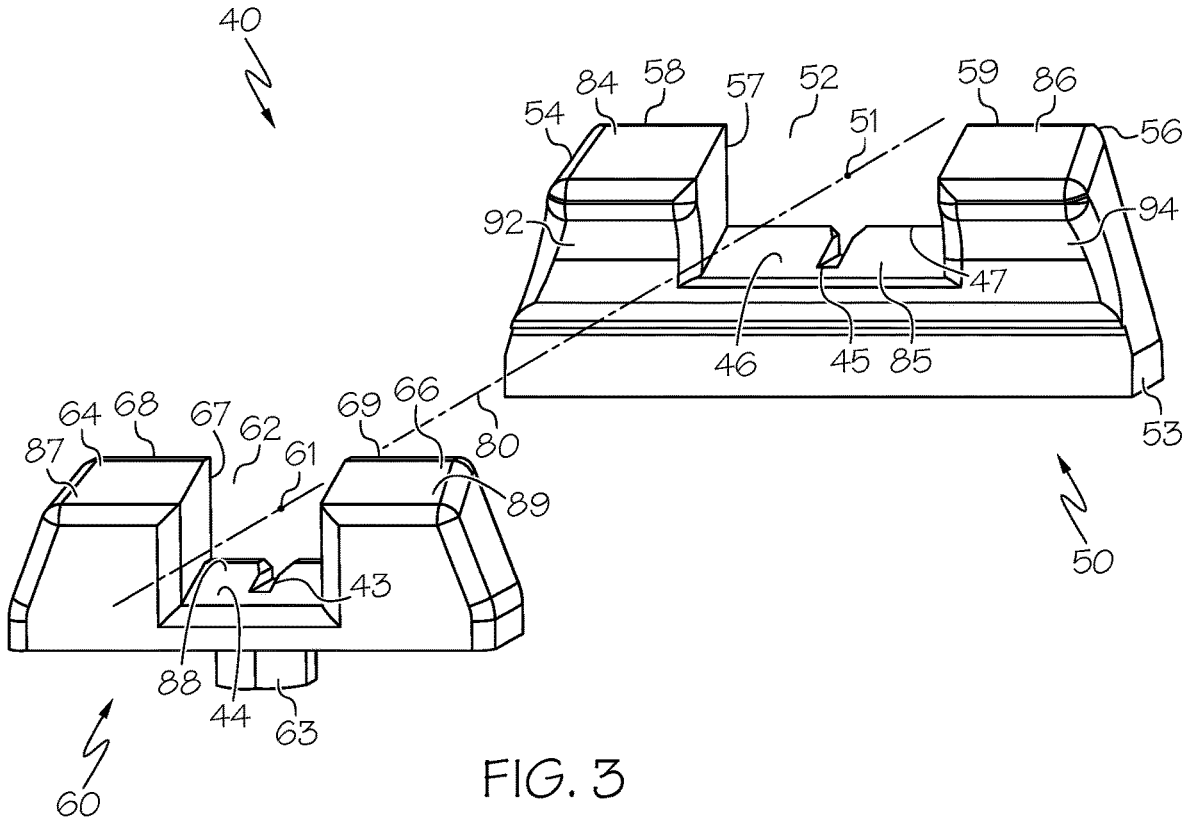
FIG. 3 shows another view of an embodiment of an aiming apparatus.

FIG. 3 shows embodiments of a first body 50 and a second body 60 from a viewing position located to the front of the aiming apparatus 40.

In some embodiments, the first body 50 comprises one or more upper surfaces 84, 85, 86 oriented at an angle to the axis 80. In some embodiments, an upper surface 84, 85, 86 is arranged to decline as the surface is traversed in a direction from the shooter toward the target. In some embodiments, the central portion 46 of the first body 50 comprises an upper surface 85 arranged to decline away from the axis 80. This helps to ensure that the upper surface 85 is not visible to a shooter, and that the base edge 47 defining the sight window 52 appears as a sharp line. In some embodiments, an upper surface 84 of the first raised portion 54 is oriented at an angle to the axis 80. In some embodiments, an upper surface 86 of the second raised portion 56 is oriented at an angle to the axis 80. This helps to ensure that the upper surfaces 84, 86 are not visible to the shooter and the top edges 58, 59 of the raised portions 54, 56, which help to define a top edge of the sight window 52, appear as sharp lines.

In some embodiments, the upper surface 84 of the first raised portion 54 is parallel to the upper surface 86 of the second raised portion 56. In some embodiments, the upper surface 85 of the central portion 46 is parallel to the upper surface 84 of the first raised portion 54.

In some embodiments, a channel 45 extends into the upper surface 85 of the central portion 46 of the first body 50. In some embodiments, a base of the channel extends parallel to the axis 80.

In some embodiments, the second body 60 comprises one or more upper surfaces 87, 88, 89 oriented at an angle to the axis 80. In some embodiments, the upper surfaces 87, 88, 89 of the second body 60 are configured similarly to the upper surfaces 84, 85, 86 of the first body 50.

In some embodiments, a channel 43 extends into the upper surface 88 of the central portion 44 of the second body 56. In some embodiments, a base of the channel 43 extends parallel to the axis 80.

Figure 4:
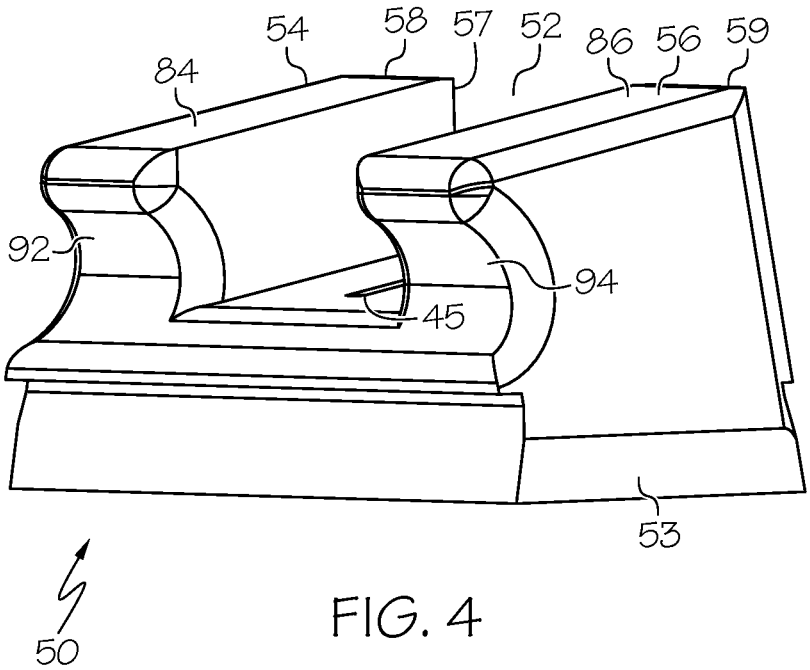
FIG. 4 shows an embodiment of a first body of an aiming apparatus.

FIG. 4 shows another view of an embodiment of a first body 50. In some embodiments, the first body 50 comprises a hook 92. In some embodiments, the first body 50 comprises a first hook 92 aligned with a second hook 94. In some embodiments, the first raised portion 54 comprises the first hook 92 and the second raised portion 56 comprises the second hook 94. In some embodiments, a hook 92, 94 comprises a concave portion and defines a cavity. In some embodiments, a hook 92, 94 can be used to engage an external structure to brace the first body 50 and attached portion of a device 38 against movement. For example, a pistol can comprise a handgrip and a slide comprising the first body 50. A user can hold a portion of a device 38 that is moveable with respect to the first body 50, such as the handgrip, and can use a hook 92, 94 to engage any suitable bracing structure and move the handgrip with respect to the slide by applying a force to the handgrip.

Figure 5:
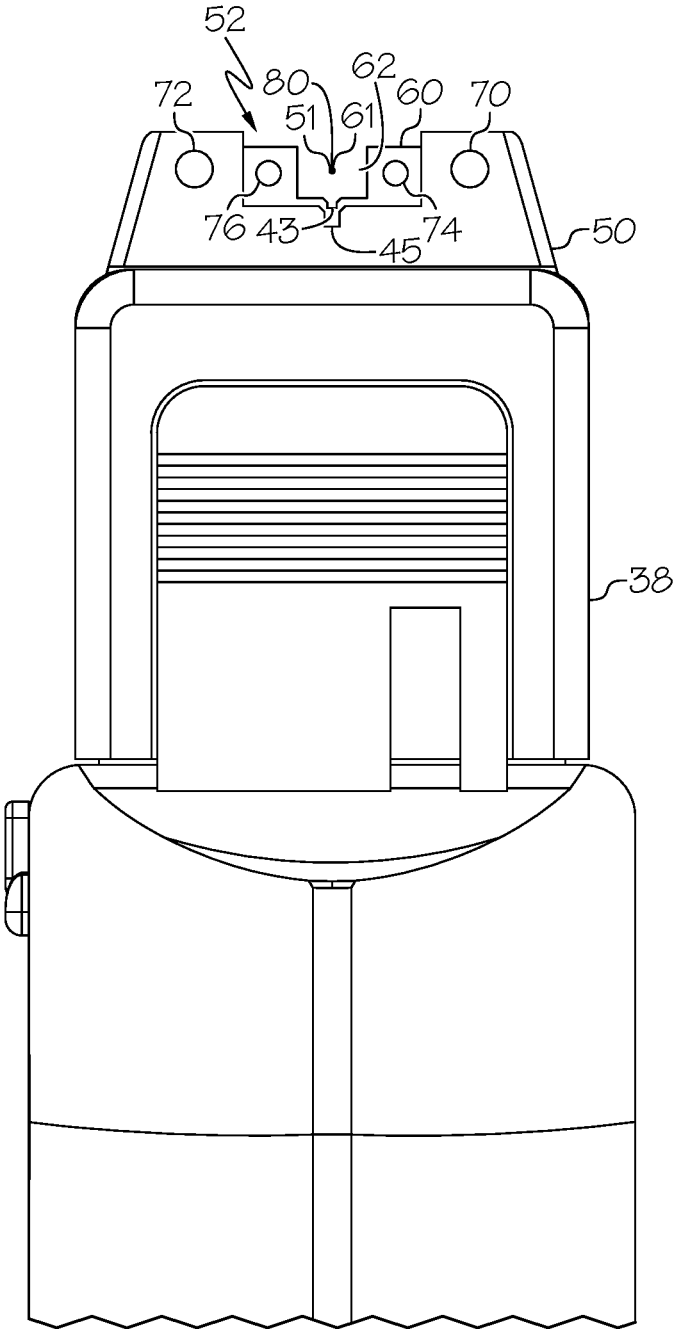
FIG. 5 shows a user's view of an embodiment of an aiming apparatus.

FIG. 5 shows an example of a shooter's view while aiming a device 38 comprising a first body 50 and a second body 60. The center 51 of the first sight window 52 is aligned with the center 61 of the second sight window 62. The second sight window 61 is visible within the first sight window 52. A target can be viewed through the first sight window 52 and through the second sight window 62.

In some embodiments, at least a portion of the indicators 74, 76 of the second body 60 are visible in the first sight window 52. In some embodiments, the entirety of each indicator 74, 76 of the second body 60 is visible through the first sight window 52. In some embodiments, at least a portion of a central indicator 43 of the second body 60 is visible in the first sight window 52. In some embodiments, a portion of the central indicator 43 of the second body 60 is visible in the central indicator 45 of the first body 50.

In some embodiments, indicators 74, 76 of the second body 60 and indicators 70, 72 of the first body 50 are generally horizontally aligned when the center 51 of the first sight window 52 is aligned with the center 61 of the second sight window 62.

In some embodiments, the axis 80 extends orthogonal to the first sight window 52 and orthogonal to the second sight window 62. In some embodiments, the axis 80 extends through a center 51 of the first sight window 52 and through the center 61 of the second sight window 62. In some embodiments, the axis 80 is orthogonal to a reference axis that extends through the indicators 74, 76 of the second body 60. In some embodiments, the axis 80 is orthogonal to a reference axis that extends through the indicators 70, 72 of the first body 50. In some embodiments, the axis 80 extends in a reference plane that intersects the first indicator 70 and the second indicator 72. In some embodiments, the reference plane further intersects the third indicator 74 and the fourth indicator 76.

Figure 6:
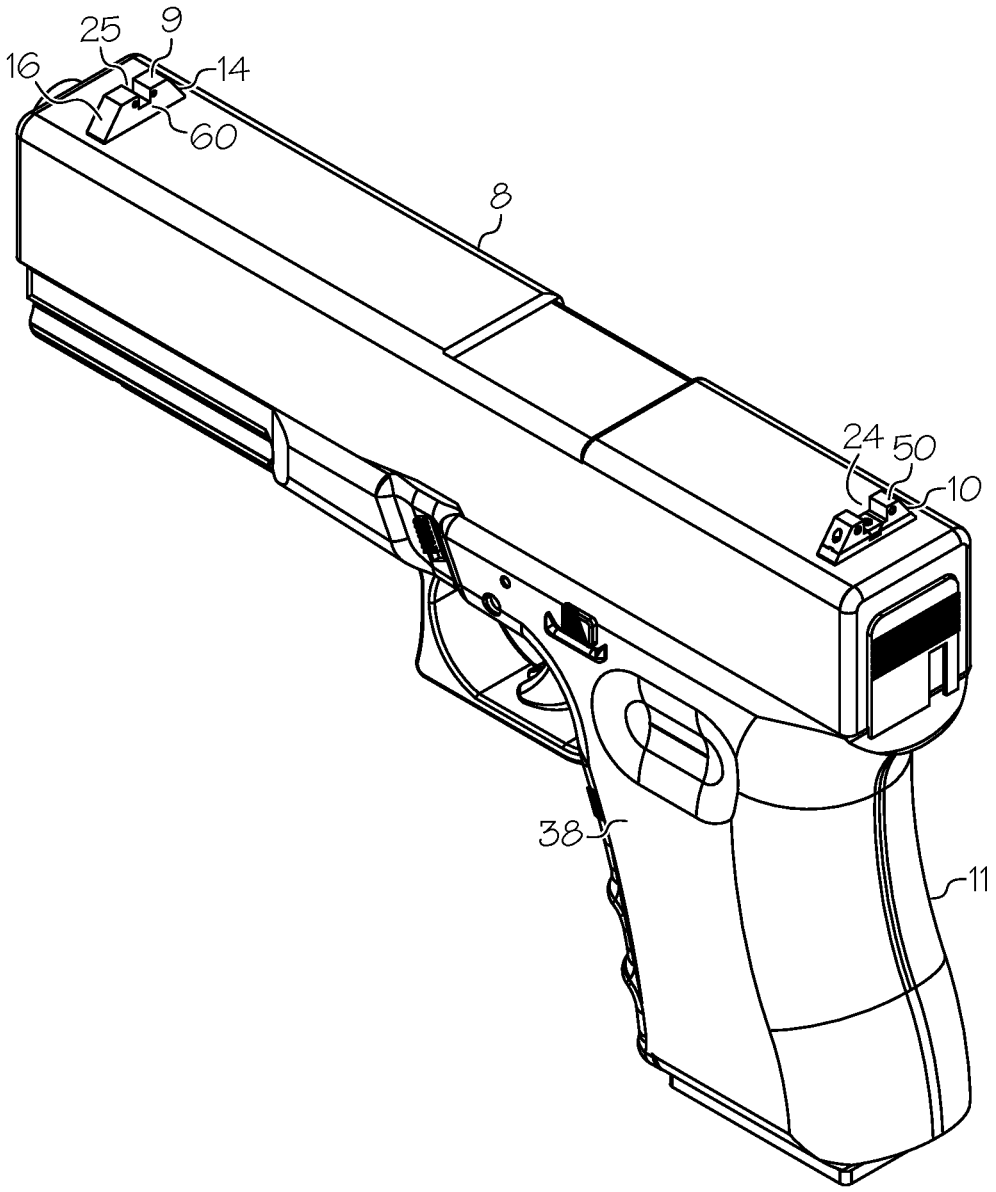
FIG. 6 shows another embodiment of an aiming apparatus.

FIG. 6 shows embodiment of a handgun 8 comprising a first body 50 and a second body 60. In some embodiments, the first body 50 comprises an adjustable sighting structure 10. In some embodiments, the adjustable sighting structure 10 defines a first adjustable cavity 24. In some embodiments, the first body 50 comprises a moveable portion and a width of the sight window is adjustable.

In some embodiments, the second body 60 comprises a second sighting structure 9 defining a second cavity 25. In some embodiments, a size of the second cavity 25 is adjustable. In some embodiments, the second body 60 comprises a moveable portion and a width of the second sight window is adjustable.

In some embodiments, the width of the first adjustable cavity 24 is proportionally related to the distance that the first body 50 and the second body 60 are spaced apart. In some embodiments, the first adjustable cavity 24 is proportionally related to the distance that the first body 50 is positioned from the user of the device. In some embodiments, the width of the first adjustable cavity 24 is proportionally related to the distance that the first body 50 is spaced apart from the second body 60 and the user of the device. In some embodiments, the first adjustable cavity 24 is proportionally related to the width of the second cavity 25. In some embodiments, the first adjustable cavity 24 is proportionally related to the width of the second cavity 25 and the distance that the first body 50 is spaced apart from the second body 60.

In some embodiments, the sight cavity 25 has a width that is proportionally related to the distance that the first body 50 and the second body 60 are spaced apart. In some embodiments, the width of the sight cavity 25 is proportionally related to the distance that the second body 60 is positioned from the user of the device. In some embodiments, the width of the sight cavity 25 is proportionally related to the distance that the first body 50 is spaced apart from the second body 60 and the user of the device.

Figure 7:
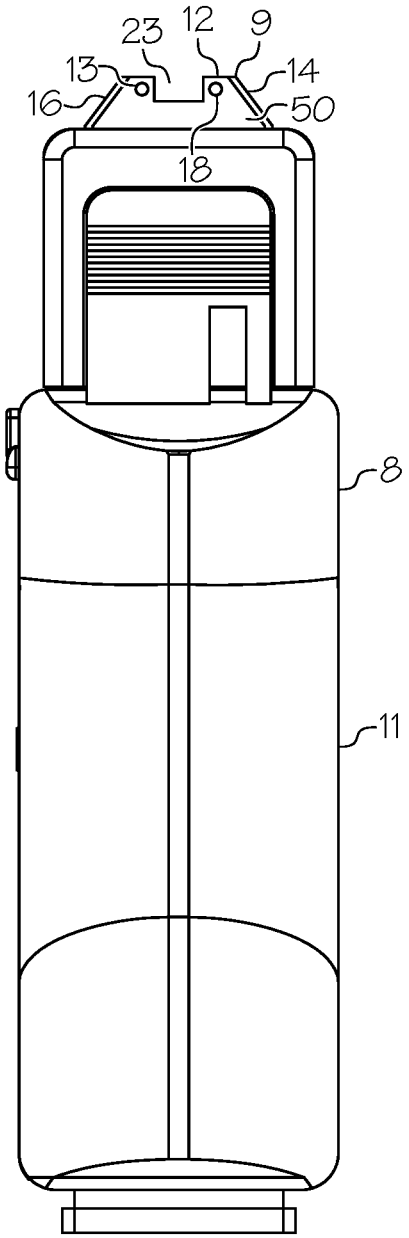
FIG. 7 shows another embodiment of an aiming apparatus.

FIG. 7 shows a rear view of an embodiment of a device 8 comprising a handgrip 11, a first sighting structure 12 and a second sighting structure 9. In some embodiments, the first sighting structure 12 comprises a first luminous element 13 and a second luminous element 18. In some embodiments, a luminous element 13, 18 comprises a fiberoptic, a light emitting diode, tritium or any appropriate material or mechanism that provides light, translucency or another suitable visual indication.

In some embodiments, the second sighting structure 9 comprises a first sighting flange 14 and a second sighting flange 16. In some embodiments, the first sighting flange 14 and the second sighting flange 16 comprise opposed outer sides of the second sighting structure 9. In some embodiments, the second sighting structure 9 is arranged such that a user viewing a sighting cavity 23 can see the first sighting flange 14 and the second sighting flange 16 extending outward beyond the first sighting structure 12. In some embodiments, the first sighting flange 14 and the second sighting flange 16 each comprise an indicator, such as a visual indicator arranged to visually contrast with the first body 50. In some embodiments, an indicator of the first sighting flange 14 and/or the second sighting flange 16 can comprise any material described with respect to other indicators herein (e.g. indicator 70).

Figure 8:
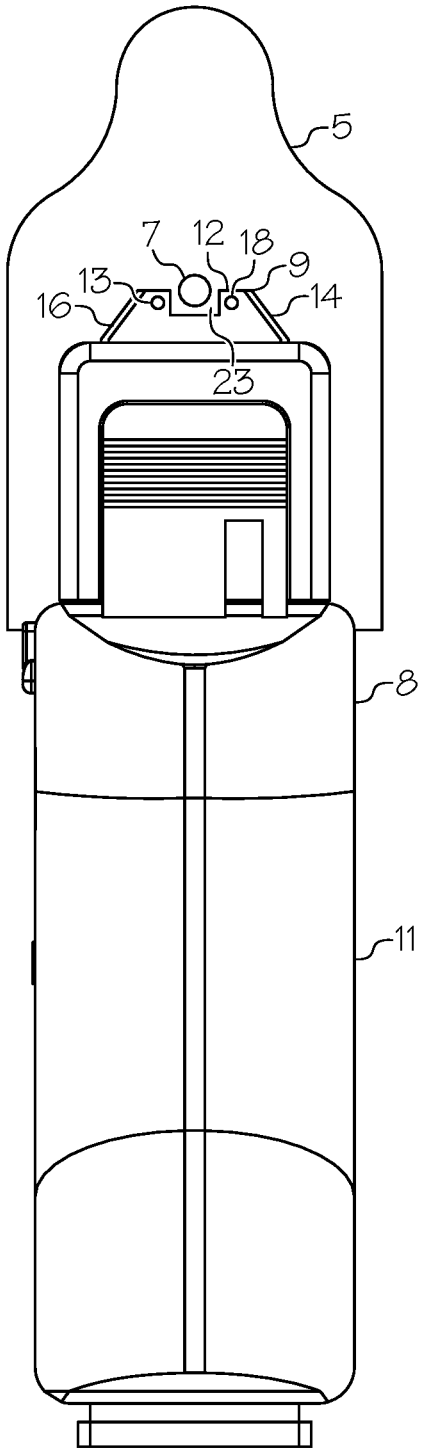
FIG. 8 shows an embodiment of an aiming apparatus and a target.

FIG. 8 shows an example of sighting alignment with the center 7 of a target 5 visible in the sighting cavity 23. In some embodiments, the first sighting structure 12 will physically occlude a portion of the second sighting structure 9. In some embodiments, the first sighting flange 14 and the second sighting flange 16 of the second sighting structure 9 extend laterally outward beyond the first sighting structure 12 and are visible. In some embodiments, both the first sighting flange 14 and the second sighting flange 16 are visible when the device 8 is aligned on target. In some embodiments, indicators of the first sighting flange 14 and the second sighting flange 16 are visible.

In some embodiments, second sighting structure 9 comprises a sight cavity 25 that is sufficiently wide that sidewall portions defining the sight cavity 25 are not visible through the cavity 24 of the first sighting structure 12.

Figure 9:
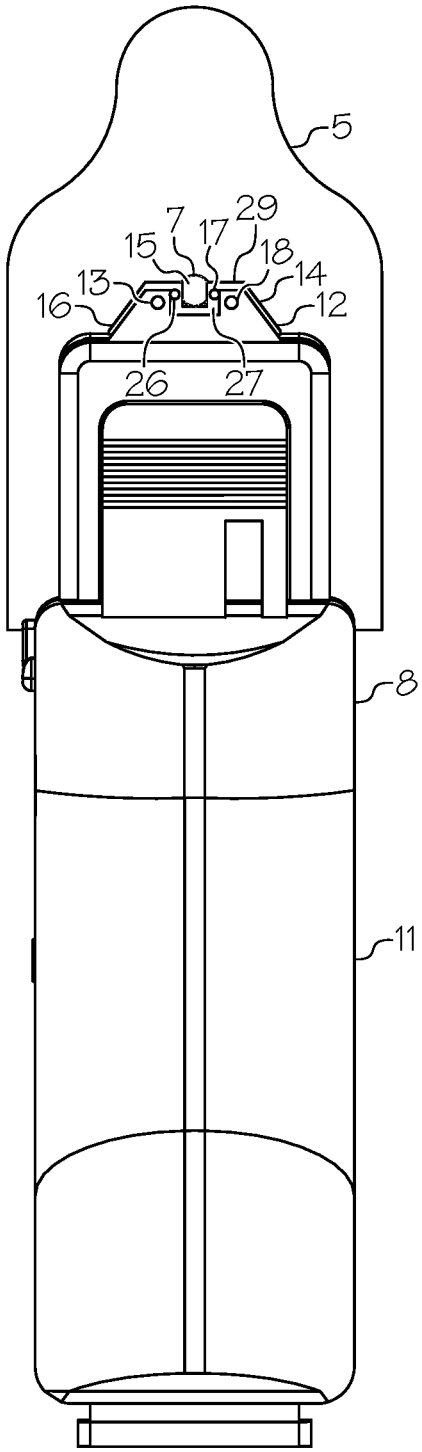
FIG. 9 shows a device comprising an aiming apparatus in a first torqued state.

FIG. 9 shows an embodiment of a second sighting structure 29 comprising a narrow sight cavity, wherein both sidewalls that define the sight cavity of the second sighting structure 29 are visible through the sight cavity 27 of the first sighting structure 12. In some embodiments, when indicators 18, 13 of the first sighting structure 12 are not aligned with indicators 17, 26 of the second sighting structure 29, the device 8 is not aimed at the center 7 of the target 5. In some embodiments, visibility of a top portion of the second sighting structure 29 above the top of the first sighting structure 12 indicates that the device 8 is not aimed at the center 7 of the target 5.

Figure 10:
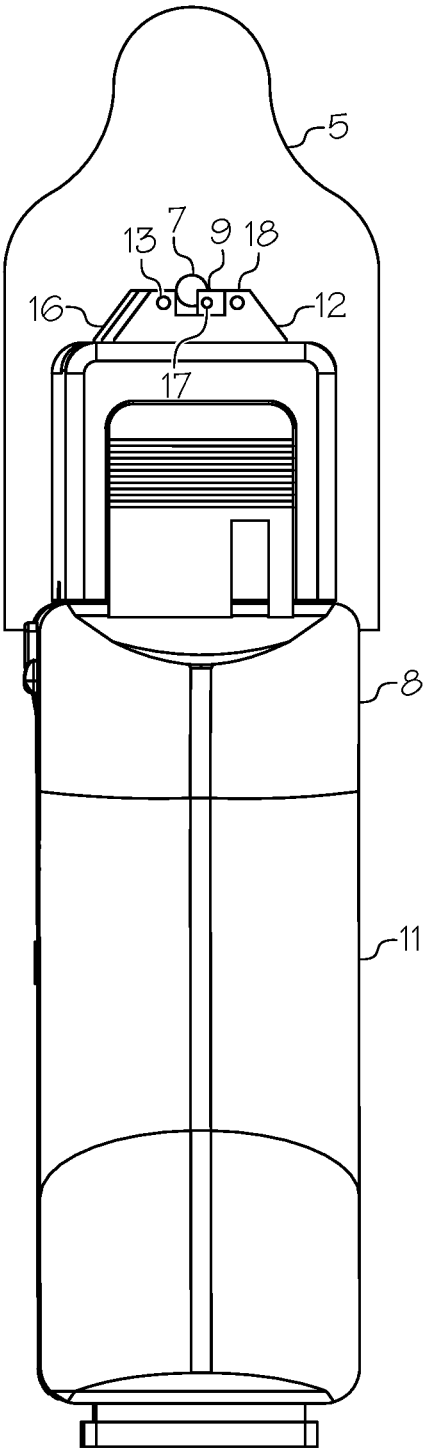
FIG. 10 shows the device of FIG. 9 in a second torqued state.

FIG. 10 shows a device 8 in a laterally torqued state, wherein the device 8 is not aligned on the center 7 of the target 5. The second sighting flange 16 is visible but the first sighting flange 14 is not visible. Only one indicator 17 of the second sighting structure 9 is visible.

Figure 11:
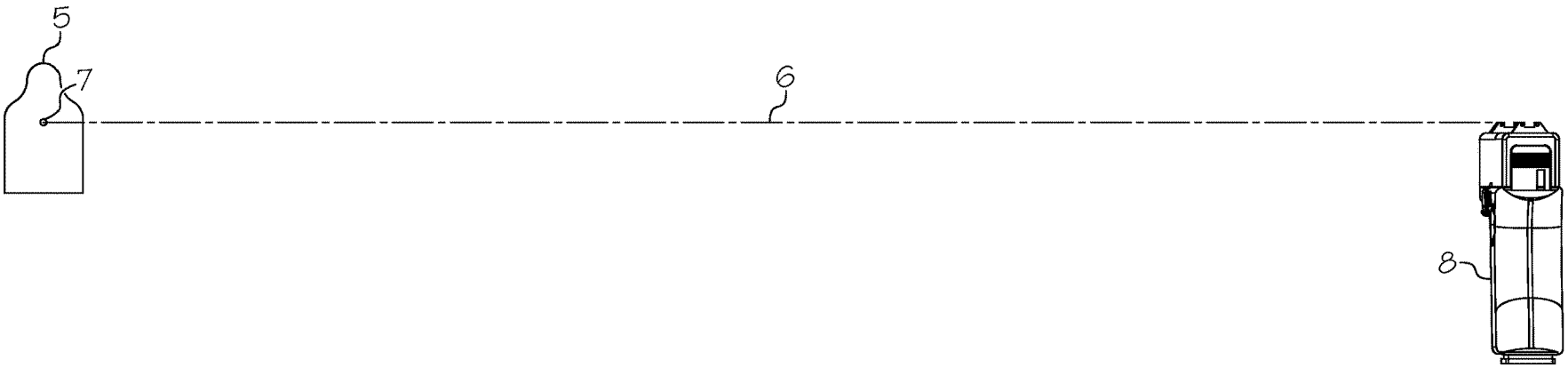
FIG. 11 shows a target and a device comprising an aiming apparatus.

FIG. 11 shows a device 8 and a target 5 spaced apart at a distance from one another.

Figure 12:
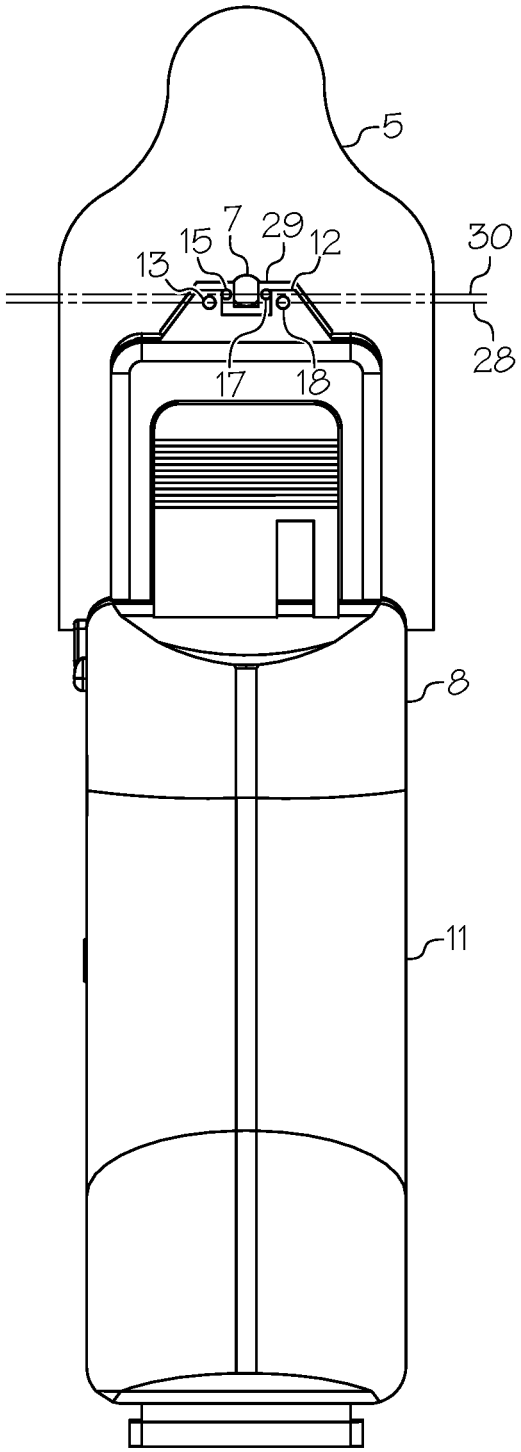
FIG. 12 shows a device aiming toward a target.

FIG. 12 shows a device 8 in a vertically torqued state such that the device 8 is not aimed directly at the center 7 of the target 5. In some embodiments, a first reference axis 28 extends through indicators 13, 18 of the first sighting structure 12. In some embodiments, a second reference axis 30 extends through indicators 15, 17 of the second sighting structure 29. In some embodiments, when the first reference axis 28 appears offset from the second reference axis 30, the device 8 is torqued in a vertical direction. In some embodiments, the first reference axis 28 and the second reference axis 30 will converge when the device 8 is aimed at the center 7 of the target 5. In some embodiments, the reference axes 28, 30 extend through a center of each associated indicator.

Figure 13:
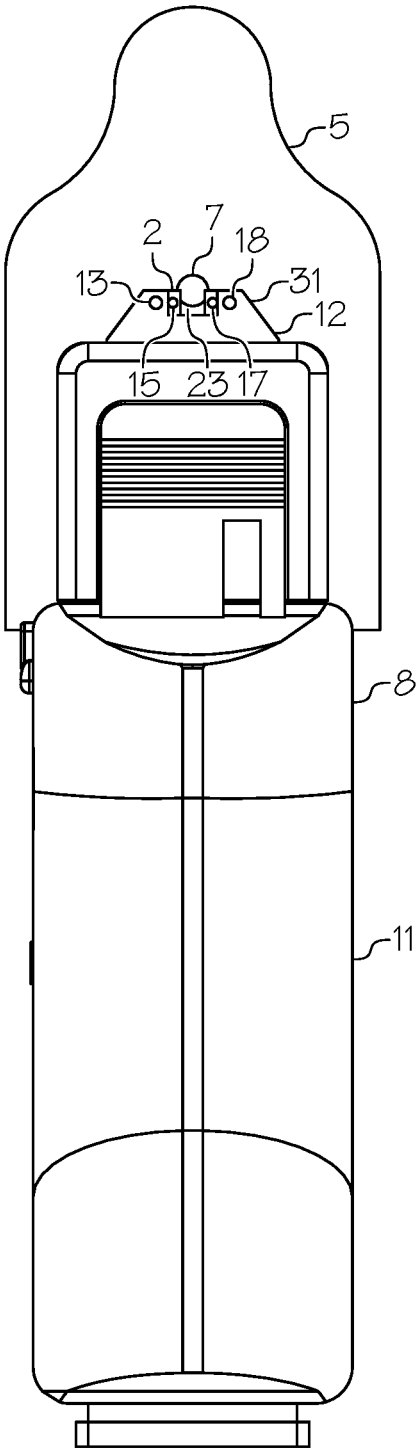
FIG. 13 shows a device aiming toward a target.
Figure 14:
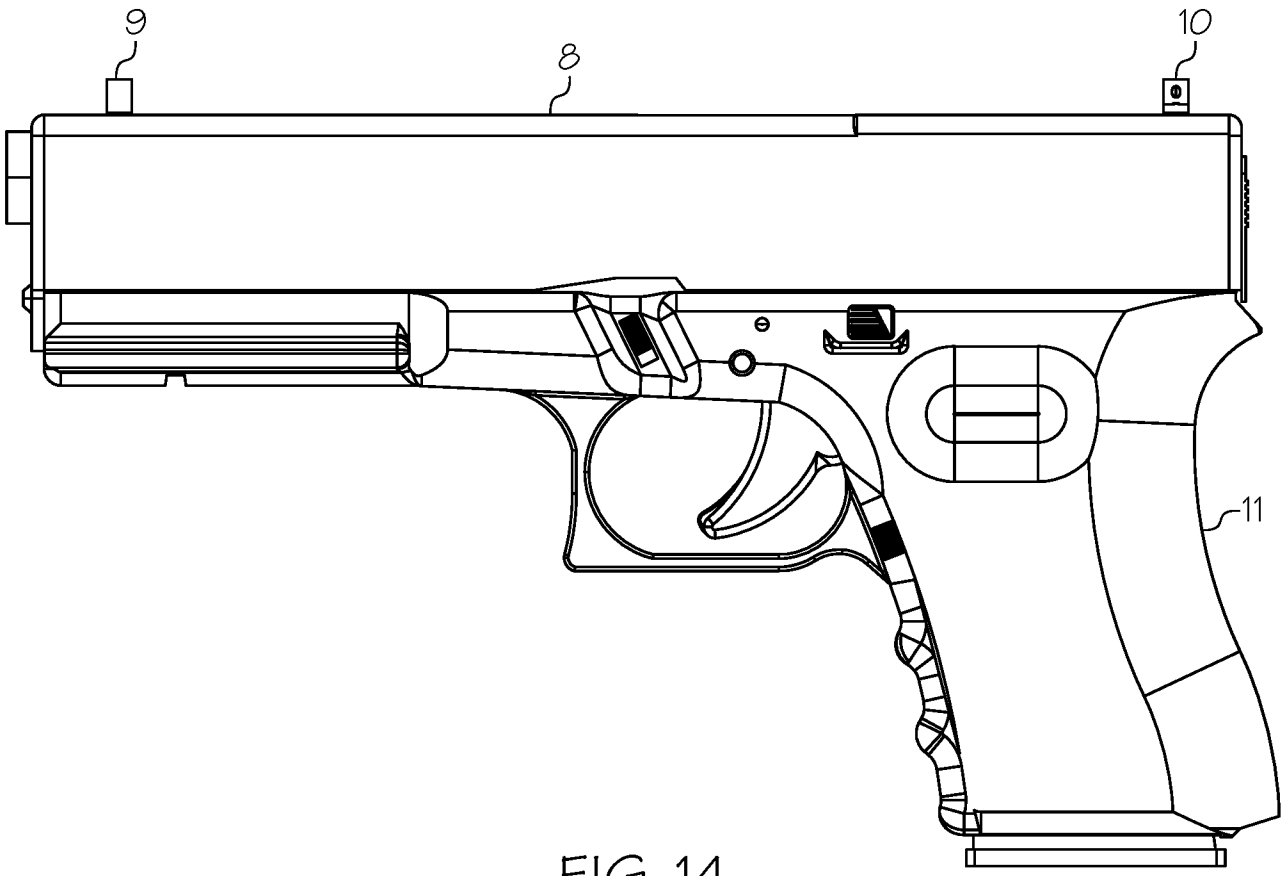
FIG. 14 shows a side view of a device.
Figure 15:
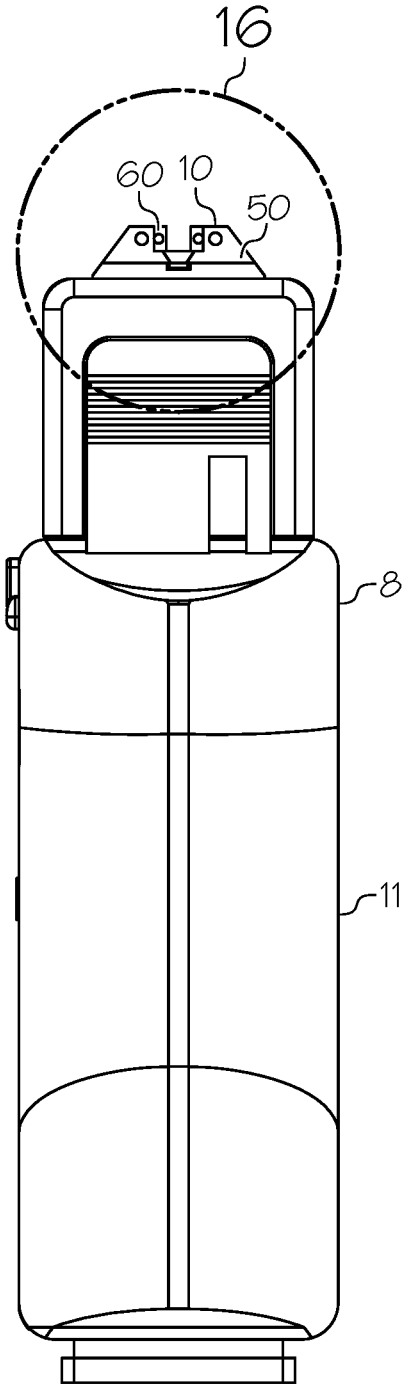
FIG. 15 is a rear view of the device of FIG. 14.
Figure 16:
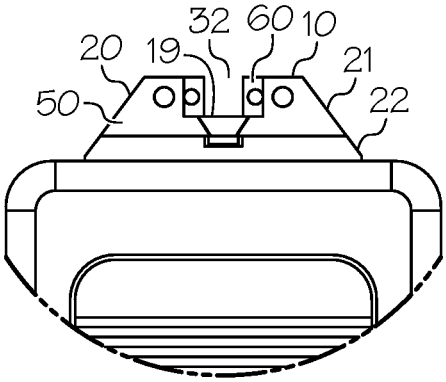
FIG. 16 shows a detail of an embodiment of an aiming apparatus.

FIG. 13 shows another potential view while aiming a device 8. FIG. 14 shows a side view of a device 8 comprising a first sighting structure 10 comprising an adjustment mechanism 19. FIGS. 15 and 16 show another potential view while aiming the device of FIG. 14.

Referring to FIGS. 13 and 16, in some embodiments, a top surface of the first body 50/first sighting structure 10 and a top surface of the second body 60/second sighting structure 9 are aligned with one another. In some embodiments, indicators of the first body 50/first sighting structure 10 and indicators of the second body 60/second sighting structure 9 are aligned on a plane that intersects the centers of the sight windows.

Figure 17:
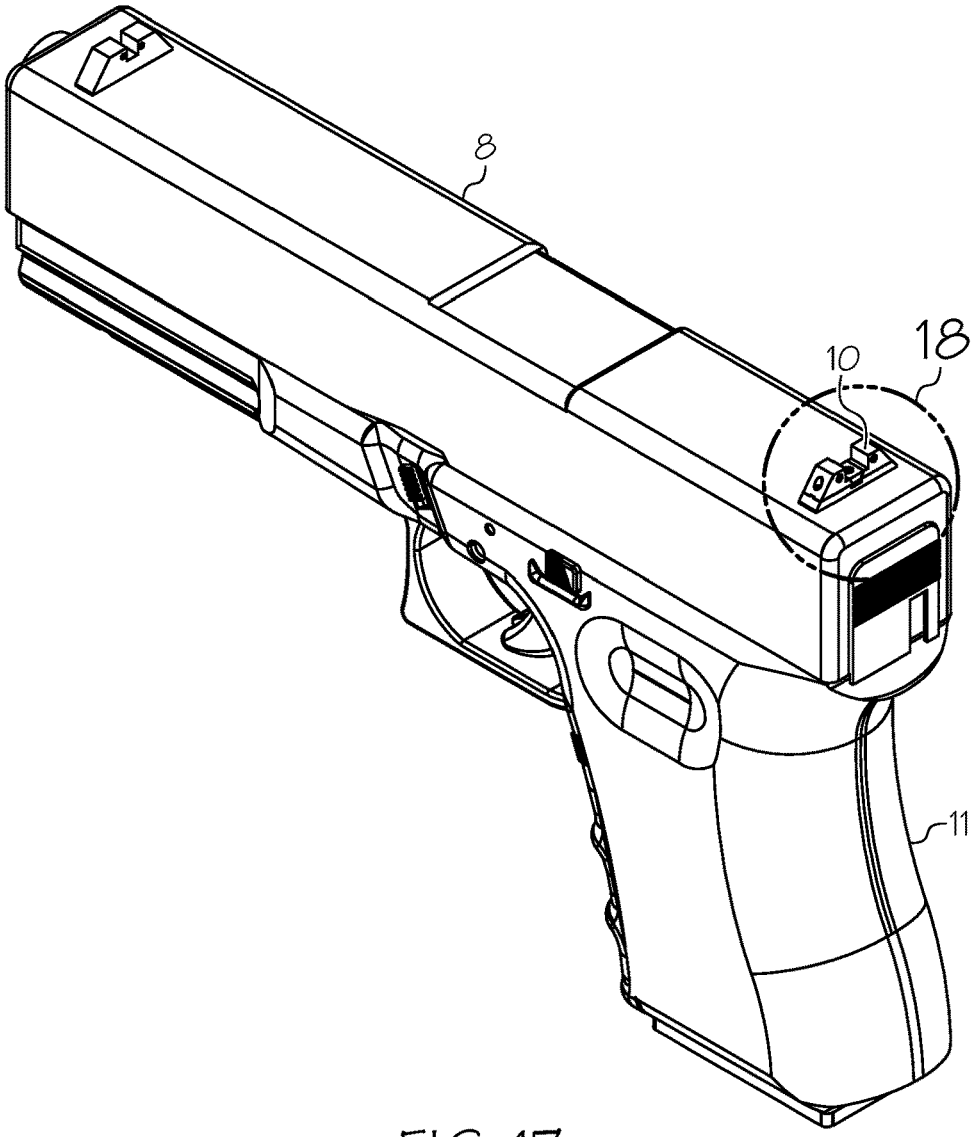
FIG. 17 shows a device another embodiment of an aiming apparatus.
Figure 18:
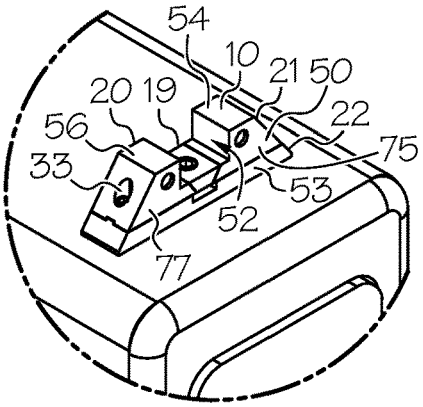
FIG. 18 shows a detail of an embodiment of a second body.

FIGS. 17 and 18 show an embodiment of an adjustable sight structure 10. In some embodiments, a first body 50 comprises an adjustable sight window 52. In some embodiments, a width of the sight window 52 is adjustable. In some embodiments, the first body 50 comprises a base 53, a first portion 75 moveable with respect to the base 53 and a second portion 77 moveable with respect to the base 53. In some embodiments, the first portion 75 comprises the first raised portion 54. In some embodiments, the second portion 77 comprises the second raised portion 56. In some embodiments, the first body 50 comprises a locking mechanism 33 arranged to lock a moveable portion 75, 77 against movement. In some embodiments, a locking mechanism comprises a fastener or set screw.

In some embodiments, the first body 50 comprises an adjustment mechanism 19 arranged to move at least one portion 75, 77 of the first body 50 with respect to the base 53. In some embodiments, an adjustment mechanism 19 is arranged to move the first portion 75 and the second portion 77 simultaneously with respect to the base 53. In some embodiments, the adjustment mechanism 19 is arranged to move the first portion 75 and the second portion 77 in equal but opposite directions with respect to the base 53. In some embodiments, movement of the first portion 75 and second portion 77 is symmetrical across the center of the sight window 52. In some embodiments, the adjustment mechanism is engaged with a central portion of the base 53. In some embodiments, the adjustment mechanism 19 comprises a trapezoidal shape. In some embodiments, the adjustment mechanism comprises a wedge. In some embodiments, the base 53 comprises a raised flange, recessed channel or other engagement mechanism and the first portion 75 and second portion 77 are shaped to engage the base 53. In some embodiments, the first portion 75 and second portion 77 are slidably engaged with the base 53.

In some embodiments, the second body 60 comprises a base and one or more portions moveable with respect to the base, for example to adjust a width of the second sight window 62. In some embodiments, the second body 60 comprises an adjustment mechanism 19 as described herein with respect to the first body 50.

Figure 19:
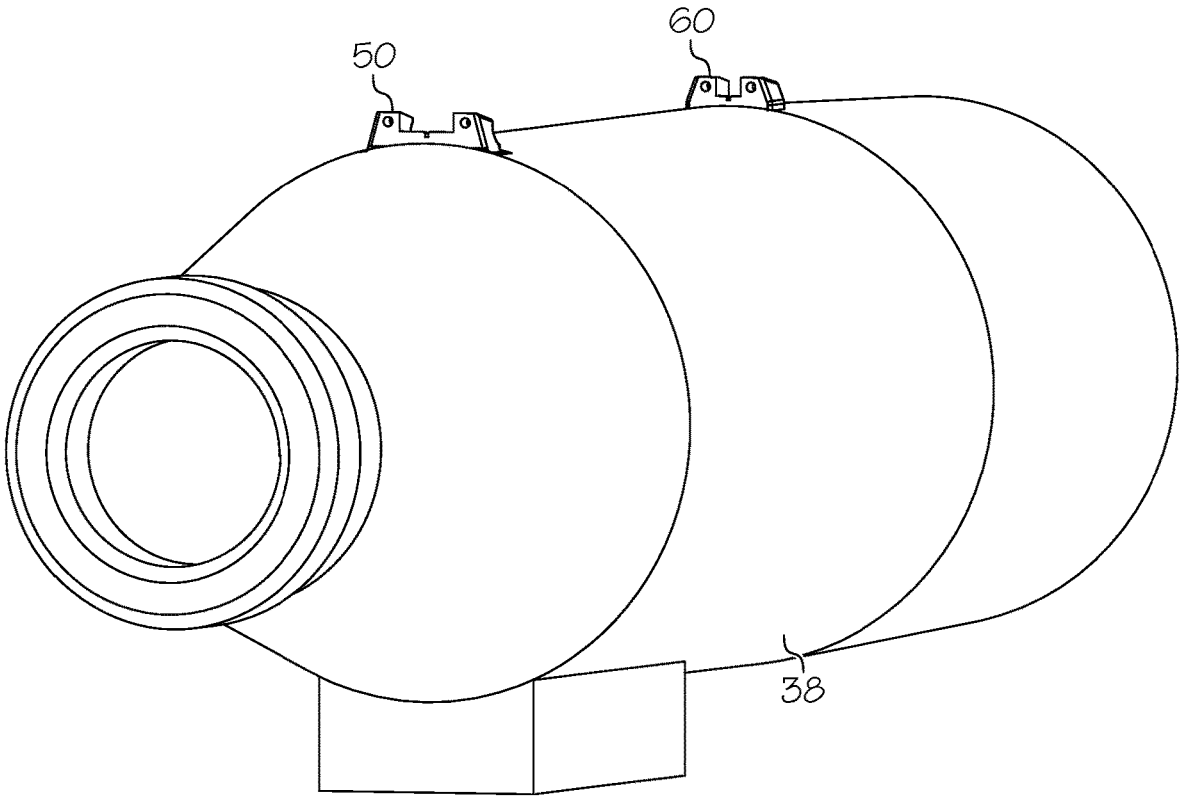
FIG. 19 shows an embodiment of a device comprising an optical scope.

FIG. 19 shows an embodiment of a first body 50 and a second body 60 attached to a device 38 comprising an optical scope.

Figure 20:
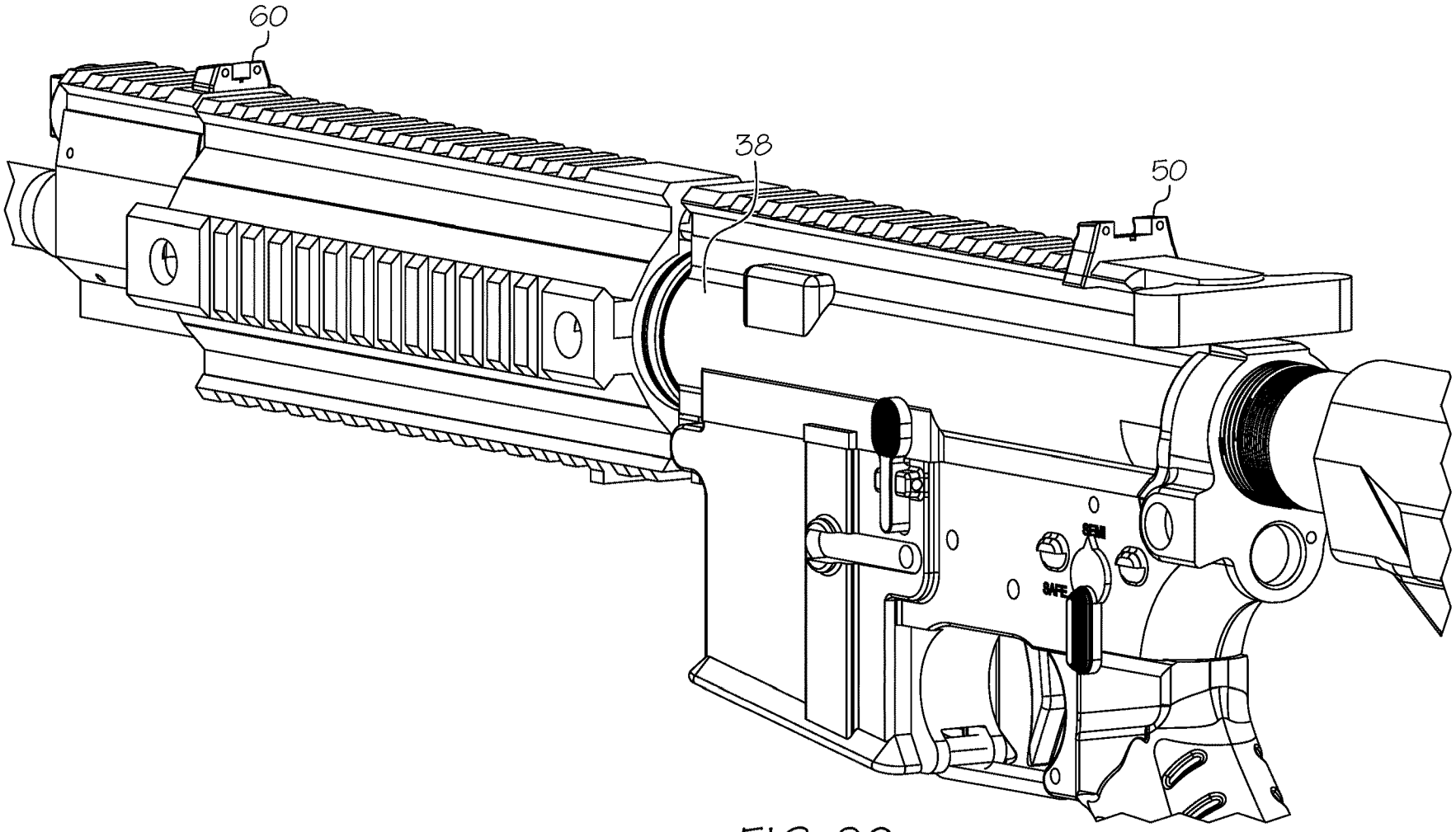
FIG. 20 shows an embodiment of a device comprising a rifle.
Figure 21:
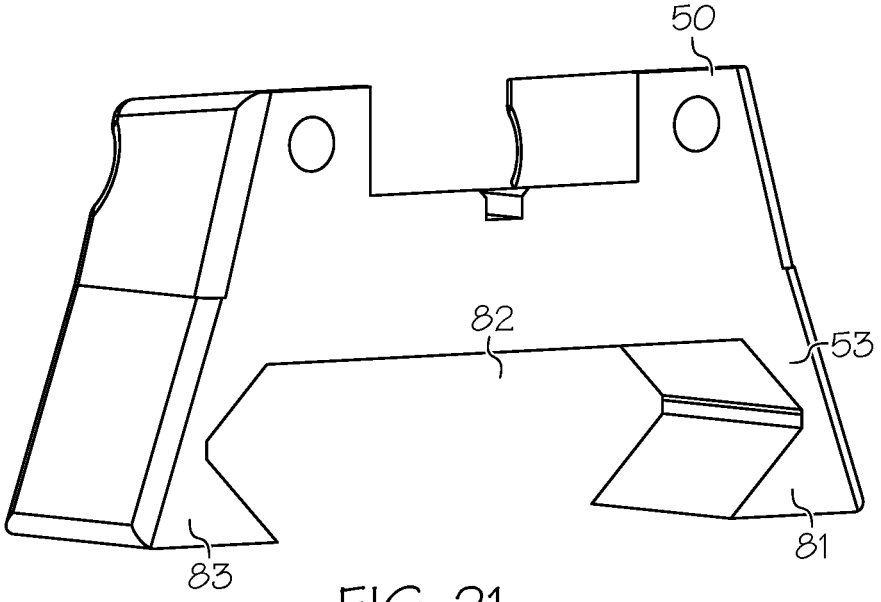
FIG. 21 shows an embodiment of a second body.

FIG. 20 shows an embodiment of a first body 50 and a second body 60 attached to a device 38 comprising a rifle. FIG. 21 shows an embodiment of a first body 50 arranged to engage a picatinny rail. In some embodiments, the first body 50 comprises a base 53 configured to engage a picatinny rail. In some embodiments, the first body 50 comprises a first engaging structure 81 and a second engaging structure 83 arranged to engage a mounting structure such as a picatinny rail. In some embodiments, the engaging structures 81, 83 define a cavity 82 arranged to accept a mounting structure such as a picatinny rail. In some other embodiments, a base 53 can be configured for any suitable known firearm accessory mounting method or rail integration system, such as a Modular Lock system, Weaver rail, KeyMod, etc.

Various embodiments of an aiming apparatus 40 comprise sight windows 52, 62 having any suitable sizing relative to one another. In some embodiments, the first sight window 52 is wider than the second sight window 62. In some embodiments, the second sight window 62 is wider than the first sight window 52. In some embodiments, two variables can help to determine proper sight window sizing—a first distance between the first sight window 52 and the second sight window 62, and a second distance between the first sight window 52 and the user's viewpoint. In some embodiments, the first distance is relatively small compared to the second distance—for example when the device 8 is a pistol. For example, the first distance between the first sight window 52 and the second sight window 62 in a pistol may be in the range of 4"-6" and the second distance is likely in the range of 10"-18". When the second distance is larger than the first distance, it is often desirable to have the first sight window 52 wider than the second sight window 62. In some embodiments, the first distance is relatively large compared to the second distance—for example when the device 8 is a rifle. For example, the first distance between the first sight window 52 and the second sight window 62 in a rifle may be in the range of 8"-18" and the second distance is likely in the range of 3"-6". When the first distance is larger than the second distance, it is often desirable to have the second sight window 62 wider than the first sight window 52.

In some embodiments, a method comprises various steps of providing and/or using the first body 50 and second body 60 as described herein. In some embodiments, a method comprises viewing a target through a first sight window and a second sight window. In some embodiments, a method comprises adjusting a width of a sight window.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An apparatus comprising:

a shooting device comprising a muzzle, a front and a rear, the muzzle located at the front;

a first body and a second body attached to the device, the first body and the second body aligned upon an axis;

the first body comprising a first base, a first raised portion and a second raised portion, the first base comprising a first base upper surface and a first base edge, the first raised portion comprising a first side edge, the second raised portion comprising a second side edge;

a first sight window defined by the first side edge, the second side edge, and the first base edge;

the first body comprising a first central indicator comprising a first channel extending into the first base edge, the first channel centered across a width of the first sight window;

the second body comprising a second base, a third raised portion and a fourth raised portion, the second base comprising a second base edge, the third raised portion comprising a third side edge, the fourth raised portion comprising a fourth side edge;

a second sight window defined by the third side edge, the fourth side edge, and the second base edge;

the second body comprising a second central indicator comprising a second channel extending into the second base edge, the second channel centered across a width of the second sight window;

the axis extending through a center of the first sight window and a center of the second sight window, wherein a width of the first channel is less than ⅓ of the width of the first sight window and wherein the first base upper surface declines in angle away from the axis from the first base edge towards the muzzle.

2. The apparatus of claim 1, wherein the width of the first sight window is different from the width of the second sight window.

3. The apparatus of claim 1, wherein a width of the first channel is the same as a width of the second channel.

4. The apparatus of claim 1, wherein a width of the second channel is less than ⅓ of the width of the second sight window.

5. The apparatus of claim 1, wherein a ratio between a width of the first channel and the width of the first sight window is different from a ratio between a width of the second channel and the width of the second sight window.

6. The apparatus of claim 1, wherein the first side edge of the first sight window is parallel to the third side edge of the second sight window.

7. The apparatus of claim 1, the second body comprising a first indicator and a second indicator, the first indicator located to a first side of the second sight window, the second indicator located to a second side of the second sight window.

8. The apparatus of claim 7, the first body comprising a third indicator and a fourth indicator, the third indicator located to a first side of the first sight window, the fourth indicator located to a second side of the first sight window.

9. The apparatus of claim 7, the first indicator comprising a radioluminescent material.

10. The apparatus of claim 1, the first body comprising an adjustment mechanism arranged to change a width of the first sight window.

11. The apparatus of claim 1, the first body comprising a hook.

12. The apparatus of claim 1, wherein the first body is positioned closer to the rear than the second body.

13. The apparatus of claim 1, wherein the second base upper surface declines in angle away from the axis from the second base edge towards the muzzle.

14. The apparatus of claim 1, wherein one of more upper surfaces of the first, second, third, and fourth raised portions decline in angle from their respective one or more top edges towards the muzzle.

15. An apparatus comprising:

a shooting device comprising a muzzle, a front and a rear, the muzzle located at the front;

a first body and a second body attached to the device, the first body and the second body aligned upon an axis;

the first body comprising a first sight window, a first indicator located to a first side of the first sight window, a second indicator located to a second side of the first sight window, and a first central indicator comprising a first channel extending into a first base edge of a first base upper surface of the first sight window, the first channel centered across a width the first base edge of the first sight window;

the second body comprising a second sight window, a third indicator located to a first side of the second sight window, a fourth indicator located to a second side of the second sight window, and a second central indicator comprising a second channel extending into a second base edge of a second base upper surface of the second sight window, the second channel centered across a width of the second base edge of the second sight window;

the axis extending through a center of the first sight window and a center of the second sight window, wherein the third indicator, the fourth indicator and the second channel are visible through the first sight window and wherein a width of the first channel is less than ⅓ of the width of the first sight window and wherein the first base upper surface of the first sight window declines in angle away from the axis from the first base edge towards the muzzle.

16. The apparatus of claim 15, wherein the first indicator, the second indicator, the third indicator, the fourth indicator are aligned on a common plane.

17. The apparatus of claim 16, wherein a center of the first sight window and a center of the second sight window are aligned on the common plane.

18. The apparatus of claim 15, wherein the width of the first sight window is different from the width of the second sight window.

19. The apparatus of claim 18, wherein a width of the first channel is the same as a width of the second channel.

* * * * *